United States Patent [19]

Rauch

[11] 4,243,439

[45] Jan. 6, 1981

[54] PROCESS OF QUENCHING METAL PIECES AND PRODUCT PRODUCED

[75] Inventor: Joseph Rauch, Vitry-sur-Seine, France

[73] Assignee: Societe de Vente de l'Aluminium Pechiney, Paris, France

[21] Appl. No.: 68,480

[22] Filed: Aug. 21, 1979

Related U.S. Application Data

[62] Division of Ser. No. 843,499, Oct. 19, 1977, abandoned.

[30] Foreign Application Priority Data

Oct. 19, 1976 [FR] France ..... 76 32035

[51] Int. Cl.[3] ..... C21D 1/44

[52] U.S. Cl. ..... 148/20.6; 148/28

[58] Field of Search ..... 148/12.4, 18, 20.6, 148/27, 28, 143

[56] References Cited

U.S. PATENT DOCUMENTS

| | | | |
|---|---|---|---|
| 2,770,564 | 11/1956 | Gordon | 148/18 |
| 2,817,612 | 12/1957 | Brennan | 148/18 |
| 2,857,301 | 10/1958 | Mauzy et al. | 148/18 |
| 3,178,321 | 4/1965 | Satterfield | 148/28 |
| 3,459,602 | 8/1969 | Mueller | 148/28 |
| 3,523,837 | 8/1970 | Paulik | 148/28 |
| 3,671,335 | 6/1972 | Paulik | 148/28 |
| 3,944,444 | 3/1976 | Thiess | 148/12.4 |
| 3,977,915 | 8/1976 | Greenwood | 148/27 |
| 4,065,329 | 12/1977 | Paulus | 148/12.4 |
| 4,126,492 | 11/1978 | Okunishi et al. | 148/12.4 |

*Primary Examiner*—L. Dewayne Rutledge
*Assistant Examiner*—John P. Sheehan
*Attorney, Agent, or Firm*—Dennison, Meserole, Pollack & Scheiner

[57] ABSTRACT

The invention concerns a new process for quenching metallic pieces and intended to limit the stresses engendered by quenching without essentially affecting the characteristics.

This process consists of quenching the pieces by immersion in a binder of the clay type suspended in water and with a mineral component such as magnetite, ferrosilicon, baryte. Products to inhibit corrosion, antifoam, or antiflocculant agents can be added to this suspension.

The invention is applied to metallic pieces, but particularly to high resistance aluminum alloy pieces which are made subject to faults caused by the stresses of excessive quenching because of their form or their dimensions.

7 Claims, 2 Drawing Figures

Figures 1, 2:
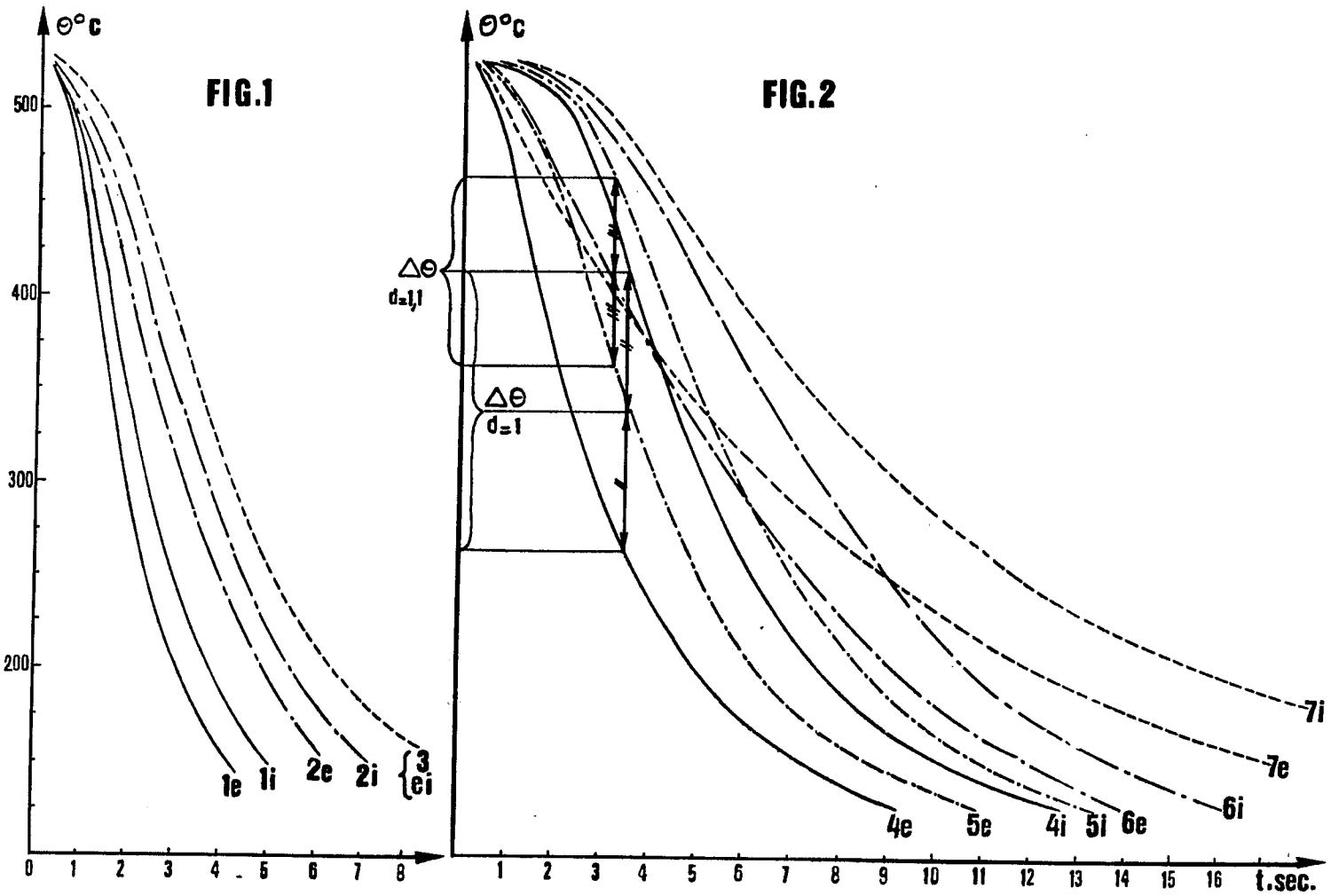

Θ°c
500
400
300
200
0
1
2
3
4
5
6
7
8
1e
1i
2e
2i
3e
3i
ΔΘ
d=1,1
ΔΘ
d=1
4e
5e
4i
5i
6e
6i
7e
7i
9
10
11
12
13
14
15
16
t.sec.

PROCESS OF QUENCHING METAL PIECES AND PRODUCT PRODUCED

This is a division of application Ser. No. 843,499, filed Oct. 19, 1977, now abandoned.

The invention is concerned with a quenching medium for metallic castings, and in particular, though not exclusively, for aluminum alloy pieces.

Although the explanations given hereinafter relate to phenomena relative to aluminum alloys, the process and quenching media claimed are applicable to all structural quenching alloys and, more generally, to all metallic alloys that react to quenching, for example, those of a structural or martensitic type.

The mechanical characteristics of certain groups of aluminum alloys can be considerably improved by heat treatment, which in general comprises the three stages of dissolving, quenching and annealing or ageing. The principle of this hardening mechanism, which is called structural hardening, implies the presence in the alloy, in equilibrium at the ambient temperature, of precipitated intermetallic compounds, i.e., outside the solid solution. The dissolving treatment has the effect of at least partly returning these phases into solid solution. Quenching brings the alloy to ambient temperature at a speed that is so high that the intermetallic compounds do not have the time to be reprecipitated thus a supersaturated metastable solid solution is obtained. By heating at a temperature lower than the dissolving temperature (annealing) or, by standing at ambient temperature ageing, very fine so-called Guinier-Preston zones are formed, which are local singularities in the distribution of the dissolved atoms. If heating is continued there is a very fine precipitation of the intermetallic compounds which then collect together and become larger and larger, that are these Guinier-Preston zones which, by blocking dislocations, are responsible for the improved mechanical characteristics of the alloys.

It is obvious that the quenching operation is fundamental: the rate of the temperature drop must be sufficiently high to prevent reprecipitation of the compounds dissolved in the preceding operation. The rate below which precipitation occurs is called the critical cooling rate and obviously varies according to the type of alloy, i.e., according to the type of phase that causes the hardening of the alloy. Thus, alloys of the aluminum-copper-magnesium type have critical cooling rates that are, for example, lower than those of aluminum-zinc-magnesium alloys.

Moreover, in the case of solid pieces it is obvious that the areas in the center of the thick pieces undergo, at the time of quenching, a smaller rate of temperature decrease than the surface areas. Thus, throughout the quenching process there is a temperature difference between the outer areas and the core of the piece and this temperature difference causes stresses within the quenched piece and sometimes deformations or even cracks or contraction cracks.

In general, quenching is carried out by immersing the casting in cold water when it leaves the dissolving furnace. Owing to its abruptness this cooling is often impracticable because it causes the above mentioned faults in the pieces.

Therefore, gentler quenching media are used, i.e., those that cause lsss sudden temperature drops involving, for example, quenching in hot or boiling water, in oil, or in water to which organic additives such as polyvinyl-alcohols, ethylene-glycol or glycerol have been added.

Finally, in the case of certain alloys with a very low critical cooling rate or where a certain loss of characteristics is permitted, spray or even pulsed-air quenching is possible. These gentler quenching media, despite their significance and wide use, have certain disadvantages: (a) Boiling water sometimes prejudices the mechanical characteristics. This method also leads to the danger of irregularities linked with the local or more or less general formation of a water vapor film, which is stable on contact with the piece (calefaction). This vapor film considerably decreases heat exchanges, which causes not only unquenched zones, but also, due to consequent surface temperature differences, an increase in the internal tension, cracks and other undesirable mechanical defects. (b) Hot, but not boiling, water leads to the same disadvantages with, in addition, an even greater irregularity of the results. Thus, the regulation of the water temperature must not be expected to bring about a cooling rate intermediate between cold and boiling water quenching. This is due to irregularities and instabilities caused by the calefaction film. (c) When oils are used, the viscosity or temperature changes do not permit of a significant adjustment of the cooling rates. In addition, oils are expensive, their decomposition products act as pollutants and they are sometimes flammable.

The present invention is based on the discovery of a quenching process involving submerging the pieces in a suspension of certain mineral powders in water. Preferably, these suspensions are sufficiently thick and have a consistency similar to that of mud. They generally contain (1) water, a base liquid; (2) a binder constituted by a clay, for example of the bentonite type, or by artificial dispersing agents; (3) optionally one or more powdered fillers, which serve to modify the specific gravity of the suspension, its viscosity or even its thermal conductivity; (4) various additives, e.g., to regulate the rheological or surface-active properties of the medium, to inhibit corrosion or to impart antiflocculating or antifoaming properties.

The binder content can vary from 3 to 20% of the total weight of the mud, the filler content from 2 to 35%, and the total content of suspended mineral substances from 5 to 50%. The powdered and preferably micronized fillers can be magnetite, $Fe_3O_4$, ferrosilicon, baryta or barium sulfate. The specific gravity of the mud can vary from 1.05 to 1.6.

Such quenching media have considerable advantages compared with those used previously. (1) By varying the proportions of binder and charges, it is possible to obtain a regular and progressive cooling reduction compared with cold water quenching. Thus, it is possible to adapt the cooling curve to the ideal curve taking account of variations in the shape and cross-section of the quenched pieces, thus bringing about a better compromise between the level of the final mechanical characteristics, which it is desired to improve, and that of the residual stresses, which it is desired to reduce. Thus, the evaporation of the liquid is limited and controlled by the dilution and by the diffusion of the liquid phase through the coating layer, which is concentrated around the hot piece, and a regulable amount of cooling is supplied by the solid suspended particles. (2) The presence of the solid suspended particles opposes the establishment or the stabilization of insulating calefaction film on the surface of the castings. (3) The intensity of the heat exchangers by convection of the pasty liquid about the piece is determined by the special characteristics of the suspension, such as its viscosity and specific gravity, and by its relative movement relative to the piece, which can be modified by programmed mixing or stirring. (4) It is much easier to prepare, use and recover the quenching media of the present invention compared with known media.

These products are in fact prepared by simple incorporation of the solid ingredients in water and no danger is occasioned by their use because they are not pollutants, are not prejudicial to work hygiene and are not inflammable.

The quenched articles merely have to be rinsed with water or a compatible liquid to remove the mud covering them, and the washing products (except for soluble products) can easily be decanted and recycled. In addition, the fillers and binders are generally inexpensive products.

The following nonlimitative examples serve to illustrate the invention.

EXAMPLE I

Aluminum alloy bars with a diameter of 20 to 50 mm and a length of 150 mm were provided in their median plane (equidistant from their ends) with two fine thermocouples, one being located in the vicinity of the outer surface and the other on the axis of the bar.

A mixture of micronized powders with the following composition by weight was prepared: clay 30%; magnetite 10%; and ferrosilicon 60%. This mixture was suspended in water in proportions between 10 and 20% by weight so as to obtain three suspensions of specific gravities 1.1, 1.2 and 1.3/g/cm$^2$.

The aluminum alloy bars were then heated to 525° C. and then quenched in water at ambient temperature or in each of the baths described above, also at ambient temperature.

The information supplied by the two thermocouples inserted in the bars is continuously recorded and provided the curves of FIG. 1 of the accompanying drawings.

In the graph of FIG. 1, the time in seconds is shown in the abscissa and the temperature on the ordinate. This graph shows five cooling curves for bars with a diameter of 20 mm, and curves (1*e*) and (1*i*) are cooling curves of the outer and inner thermocouples respectively in the case of quenching in pure water.

Curves (2*e*) and (2*i*) are cooling curves for the outer and inner thermocouples in the case of quenching in liquid of specific gravity 1.2.

Curve 3 is the cooling curve of outer and inner thermocouples (curves virtually coincide) for quenching in liquid of specific gravity 1.3.

The graph of FIG. 2 of the accompanying drawings shows identical curves but in the case of bars with a diameter of 50 mm:

(4*e*) and (4*i*): quenching in pure water, external and internal thermocouples;

(5*e*) and (5*i*): quenching in liquid of specific gravity 1.1, external and internal thermocouples;

(6*e*) and (6*i*): quenching in liquid of specific gravity 1.2, external and internal thermocouples;

(7*e*) and (7*i*): quenching in liquid of specific gravity 1.3, external and internal thermocouples.

In the case of curves (4*e*) and (4*i*) on the one hand, and curves (5*e*) and (5*i*) on the other, the segments $\Delta\theta$ representing the location of the maximum variations between the external and internal temperatures have been plotted. Examination of these curves reveals for the case of quenching in suspension compared with ordinary quenching:

a regular and progressive reduction in cooling;

a resulting decrease in the temperature variations between the medium and the periphery of the test pieces (40 to 60% for diameter 50 mm);

a displacement towards higher temperatures of the point at which the maximum variation between internal and external temperatures occurs (approximately 60° C., from 340° to 400° C. in the same cases).

Thus, the novel quenching media in this Example lead to greater improvements than the known reduced quenching media (e.g., boiling water, oil and organic solutions) of the following characteristics: there is very little change to the characteristics particularly the final mechanical characteristics, the slowing down of cooling not being exaggerated at elevated temperatures which determine the subsequent evolution of the quencher solid solutions; there is a reduction of the residual stresses caused by quenching because the maximum variation between the core and surface temperature is greatly reduced, the temperature range where this variation occurs is displaced towards the higher temperature where the alloy is very plastic, and the erratic and abrupt phenomena of calefaction are eliminated.

EXAMPLE 2

Parallelepipedal bars of dimensions 33×35×200 mm were cut from a sheet of alloy A-U$_4$G$_1$ (alloy 2024 according to the standards of the Aluminum Association).

These bars underwent a dissolving treatment at 495° C. for 1 and one-half hours, and then after quenching in one of the media described hereinafter they were aged for four days at ambient temperature. Their mechanical characteristics were then measured, i.e., the breaking loads R, the elastic limit at 0.2% elongation LE, elongation at break A, Brinell hardness HB and residual stresses $\sigma$.

The residual stresses were measured in the following way. The bars were sawn in the longitudinal direction and the deflection of the bars was measured. The stress level $\sigma$ is then expressed by the formula:

$$\sigma = 2.4\frac{Eh}{L2}f;$$

f=deflection in mm; E=modulus of elasticity in hectobars; L=bar length in mm; h=bar thickness; and 2.4 is an experimentally evaluated numerical factor. The following experimental quenching media were used: (1) cold water with no additives; (2) boiling water; (3) commericial quenching oil; (4) water to which had been added 5% by weight of a commercial quenching additive; (5) 40% by weight solid suspension of a powder of composition by weight: 70% magnetite, 30% betonite (composition 5); (6) 28.7% by weight solid suspension of a mixture of composition by weight: magnetite 18%, ferrosilicon 55% (composition 6), bentonite 27%; and (7) 25.5% by weight solid suspension of a mixture of composition by weight: magnetite 30%, ferrosilicon 30% (composition 7), bentonite 40%.

The results are given in the following table in which the first five columns are the absolute values measured and the five following columns the relative values equal to 100% those obtained with cold water being used for reference purposes. It is clear that the higher R, LE, A, and HB and the lower $\sigma$, the more effective the quenching medium. The tensile strength and yield strength are expressed in hbar in the same way as the residual stresses.

| Quenching Medium | % Solids Total Weight | Mechanical Characteristics and Stresses (hbar and %) Absolute LE | R | A % | HB | $\sigma$ | Relative LE | R | A % | HB | $\sigma$ |
|---|---|---|---|---|---|---|---|---|---|---|---|
| Water at 20° C. | | 31.7 | 46.9 | 20 | 137 | 16.2 | 100 | 100 | 100 | 100 | 100 |
| Boiling Water | | 26.4 | 42.4 | 15.6 | 121 | 0.9 | 83 | 90 | 78 | 88 | 6 |
| Quenching Oil | | 30.7 | 46.4 | 18.6 | 132 | 3.5 | 96 | 99 | 93 | 96 | 22 |
| 5% quenching Additive | | 29 | 44.5 | 18 | 125 | 5.6 | 91 | 95 | 90 | 91 | 35 |
| Composition 5 | 40% | 32.3 | 47.5 | 17.9 | 133 | 5.3 | 102 | 101 | 89 | 97 | 33 |
| Composition 6 | 28.7% | 30.8 | 46.2 | 20 | 132 | 4.6 | 97 | 99 | 100 | 96 | 28 |
| Composition 7 | 25.5% | 31.5 | 46.9 | 19.2 | 131 | 6.5 | 99 | 100 | 96 | 96 | 40 |

The table shows that the residual stresses are best eliminated by quenching with boiling water but this accompanied by a significant loss of characteristics.

Quenching oil leads to a good compromise with a residual stress level of only 22% and a relative value of the characteristics of 96%. Composition 6 gives a stress level which is almost as low, i.e., 28% with an average value for the characteristics of 98% without causing the disadvantages inherent in the use of an oil and which have been indicated hereinbefore.

I claim:

1. In the process of heat treating metallic pieces of quenchable alloys, the improvement comprising subjecting the pieces as removed from a dissolving treatment furnace to quenching in a composition comprising an aqueous suspension of a binder and a pulverulent filler component to selectively modify the density, viscosity and heat conductivity of the composition to thereby assure an improved low level of internal stresses in the heat treated pieces.

2. The process of claim 1 wherein the binder comprises between about 3 and 20% clay by weight.

3. The process of claim 1 wherein the pulverulent filler content comprises a mineral present between about 2 and 35% by weight.

4. The process of claim 2 wherein the clay is of the bentonite type.

5. The process of claim 3 wherein the filler is selected from the group consisting of magnetite, ferrosilicon, barite or mixtures thereof.

6. The process of claim 1 wherein the binder and filler comprise from about 5 to 50% by weight.

7. The process of claim 1 wherein the specific gravity is in the range of about 1.05 to 1.6.

* * * * *